US010259224B2

(12) United States Patent
Hamade

(10) Patent No.: US 10,259,224 B2
(45) Date of Patent: Apr. 16, 2019

(54) LIQUID EJECTION HEAD, METHOD FOR PRODUCING THE SAME, AND PRINTING APPARATUS

(71) Applicant: CANON KABUSHIKI KAISHA, Tokyo (JP)

(72) Inventor: Yohei Hamade, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/993,957

(22) Filed: May 31, 2018

(65) Prior Publication Data

US 2018/0354263 A1 Dec. 13, 2018

(30) Foreign Application Priority Data

Jun. 8, 2017 (JP) ..... 2017-113562

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/164* (2013.01)

(58) Field of Classification Search
CPC ..... B41J 2/1404; B41J 2/1433; B41J 2/162; B41J 2/164
USPC ..... 347/45, 47
See application file for complete search history.

(56) References Cited

U.S. PATENT DOCUMENTS

| | | | | |
|---|---|---|---|---|
| 7,506,962 | B2 | 3/2009 | Murakami et al. | |
| 7,926,912 | B2 | 4/2011 | Murakami et al. | |
| 8,025,362 | B2 | 9/2011 | Murakami et al. | |
| 8,167,407 | B2 | 5/2012 | Murakami et al. | |
| 8,382,248 | B2 | 2/2013 | Murakami et al. | |
| 8,936,350 | B2 * | 1/2015 | Takei | B41J 2/1404 347/47 |
| 8,957,151 | B2 | 2/2015 | Tsutsui et al. | |
| 9,029,074 | B2 | 5/2015 | Hamade et al. | |
| 9,150,697 | B2 | 10/2015 | Sawada et al. | |
| 9,273,187 | B2 | 3/2016 | Sawada et al. | |
| 9,359,538 | B2 | 6/2016 | Tsutsui et al. | |
| 9,394,409 | B2 | 7/2016 | Sawada et al. | |
| 9,409,397 | B2 | 8/2016 | Tsutsui et al. | |
| 9,707,759 | B2 | 7/2017 | Takahashi et al. | |
| 2014/0309329 | A1 | 10/2014 | Sawada et al. | |

FOREIGN PATENT DOCUMENTS

JP 4818276 B2 11/2011

* cited by examiner

*Primary Examiner* — An H Do
(74) *Attorney, Agent, or Firm* — Venable LLP

(57) ABSTRACT

A liquid ejection head includes an ejection orifice configured to eject a liquid, the ejection orifice has at least one protrusion protruding from the peripheral portion of the ejection orifice toward the center of the ejection orifice, and the protrusion includes, on the outer surface including at least the protrusion edge, a highly water-repellent region having a higher water repellency than that of the outer surface of the periphery of the ejection orifice.

14 Claims, 8 Drawing Sheets

LIQUID EJECTION HEAD, METHOD FOR PRODUCING THE SAME, AND PRINTING APPARATUS

BACKGROUND OF THE INVENTION

Field of the Invention

The present invention relates to a liquid ejection head capable of ejecting droplets of a liquid such as an ink, a method for producing the liquid ejection head, and a printing apparatus.

Description of the Related Art

In order to achieve satisfactory liquid ejection performances in a liquid ejection head capable of ejecting droplets of a liquid such as an ink, it is important to control the surface characteristics of the face (outer surface) of ejection orifices. When a liquid pools around an ejection orifice, a liquid may fly in an incorrect direction or a load may be applied to an ejecting liquid to reduce the ejection speed of the liquid. Methods of solving such problems to eject a liquid with high precision include a method of subjecting the periphery of ejection orifices to a liquid-repellent treatment.

For a liquid ejection printer required to output high-definition images such as photographs, satellites that degrade image qualities are preferably suppressed as much as possible. Japanese Patent No. 4818276 discloses, as a method of suppressing satellites, a method of forming at least one protrusion protruding from the peripheral portion of an ejection orifice to shorten tailing.

When an ejection orifice having such a complicated shape is subjected to such a liquid-repellent treatment as above, an ink still adheres with high probability as compared with an ejection orifice having a round hole shape without protrusions.

Until now, even when a liquid stays on the whole surface of ejection orifices, the liquid can be removed from the periphery of the ejection orifices by wiping at the time of ejection orifice face cleaning or by refreshment at the time of liquid ejection and thus has not caused serious problems.

SUMMARY OF THE INVENTION

Inks used in recent office printers are intended to improve the toughness of printed images and thus are likely to adhere to an ejection orifice face. In particular, an ink containing a resin having local polarization or charges is likely to adhere. This is because the ink causes electrostatic adsorption to a polarized portion of an ejection orifice face-forming material or to a charged portion by friction including wiping and is likely to adhere. Studies by the inventors suggest that when a liquid-repellent treatment is performed on the whole ejection orifice face, a liquid unfortunately stays on the whole ejection orifice face, and the treatment produces a little adhesion prevention effect.

On this account, an ejection orifice that has protrusions but has caused no problems is likely to cause ink adhesion and is likely to cause poor satellite break or printing failure including print deflection.

In view of the above problems, the present invention is intended to provide a liquid ejection head including an ejection orifice having a protrusion with an outer surface to which a liquid is unlikely to adhere, a method for producing the liquid ejection head, and a printing apparatus.

In order to achieve the object, a liquid ejection head pertaining to the present invention is a liquid ejection head including an ejection orifice configured to eject a liquid, the ejection orifice has at least one protrusion protruding from a peripheral portion of the ejection orifice toward a center of the ejection orifice, and the protrusion includes, on an outer surface including at least a protrusion edge, a highly water-repellent region having a higher water repellency than that of an outer surface of a periphery of the ejection orifice.

A method for producing a liquid ejection head including an ejection orifice having a protrusion pertaining to the present invention is a method for producing a liquid ejection head including an ejection orifice configured to eject a liquid, and the ejection orifice has at least one protrusion protruding from a peripheral portion of the ejection orifice toward a center of the ejection orifice. The method includes 1) a step of forming a photocationic polymerizable resin layer on a substrate, 2) a step of forming, on the photocationic polymerizable resin layer, a water-repellent layer containing a compound having a fluorine-containing group that is eliminated by photoirradiation, 3) a first exposure step of partly exposing the water-repellent layer and the photocationic polymerizable resin layer to form an ejection orifice pattern, 4) a second exposure step of exposing the water-repellent layer where an outer surface including at least a protrusion edge in a portion to be the protrusion of the ejection orifice is an unexposed portion, thereby eliminating the fluorine-containing group in an exposed portion, and 5) a step of developing the water-repellent layer and the photocationic polymerizable resin layer to form the ejection orifice.

A printing apparatus pertaining to the present invention includes the above liquid ejection head.

A printing method pertaining to the present invention uses the above printing apparatus to eject an ink from the printing apparatus, thereby applying the ink to a printing object.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments pertaining to the present invention will now be described with reference to drawings, but the present invention is not intended to be limited to the embodiments. In the following description, components having identical functions are represented by identical numerals and may not be elaborated.

Figure 8:
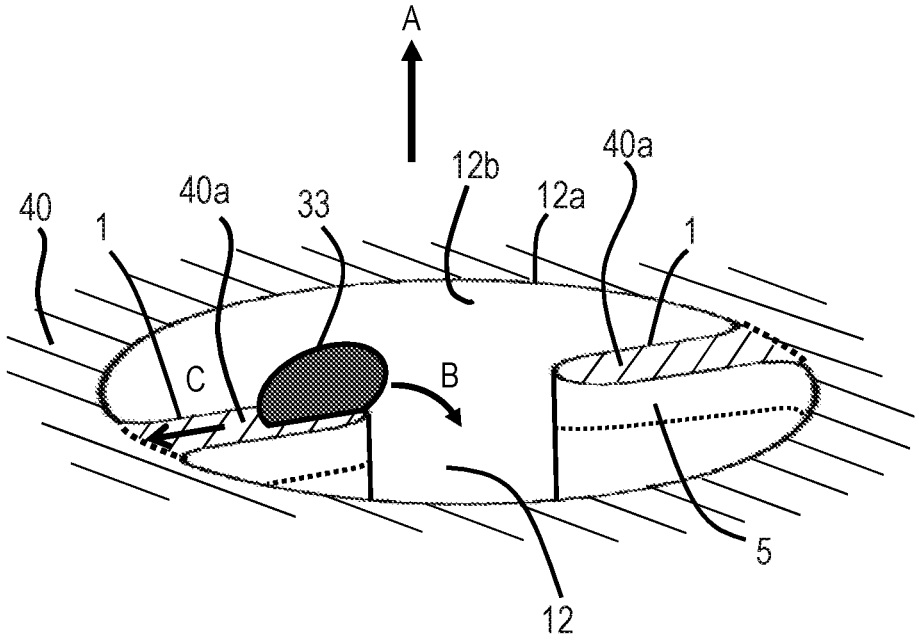
FIG. 8 is a perspective view of an ejection orifice for describing liquid adhesion.

First, the liquid adhesion to an ejection orifice having protrusions mentioned in Description of the Related Art will be described with reference to FIG. 8. FIG. 8 is a perspective view of an ejection orifice 12 communicating with an ink flow channel not shown in the drawing. On the ejection orifice 12, protrusions 5 are provided to protrude from a peripheral portion 12*a* toward the center of the ejection orifice 12. A liquid is ejected from the ejection orifice 12 in the arrow direction A. A liquid 33 staying on the outer surface 40*a* of a protrusion 5 is unlikely to move toward the inside of the ejection orifice 12 (in the direction indicated by the arrow B) due to a pinning effect at the protrusion edge 1 of the protrusion 5 but only moves in the outer circumferential direction of the ejection orifice (the direction indicated by the arrow C). In the structure in Description of the Related Art, the outer surfaces 40*a* of the protrusions 5 and the outer surface on the periphery of the ejection orifice (called an ejection orifice peripheral face) 40 have the same liquid repellency (water repellency), and a liquid moves freely. Hence, the liquid 33 can stay on the outer surface 40*a* of the protrusion 5 and may adhere thereto. The "protrusion edge" means the outer peripheral edge of a protrusion.

(Action)

Figure 1:
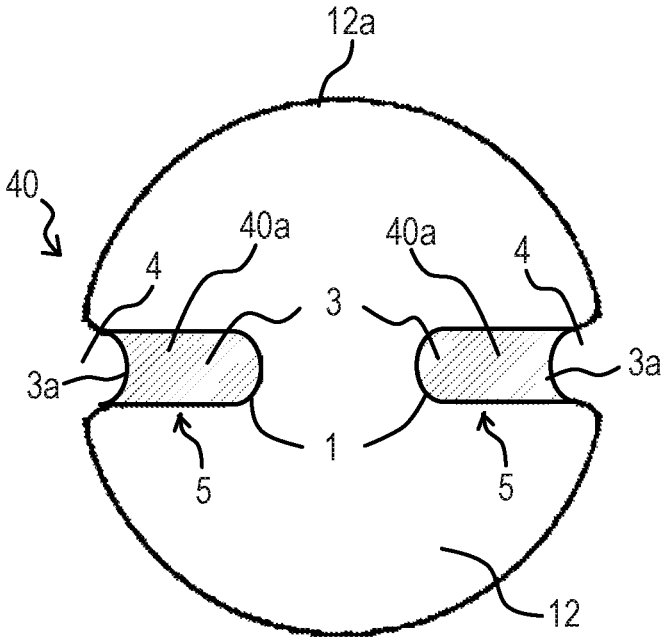
FIG. 1 is a plan view for describing an ejection orifice shape pertaining to an embodiment of the present invention.

The action of the present embodiment will next be described. In the present embodiment, as shown in FIG. 1, for example, an ejection orifice 12 having two protrusions 5 has, in a region including at least a protrusion edge 1 on the outer surface 40*a* of each protrusion 5, highly water-repellent regions (the region indicated by oblique lines in FIG. 1) 3 that have a higher water repellency than that of an outer surface 40 of the periphery of the ejection orifice.

With the structure, even when a liquid (hereinafter also called an "ink") stays temporarily on the outer surface 40*a* of a protrusion 5, the ink does not stay in the highly water-repellent region 3 and is likely to move to a region having a low water repellency (the region other than the highly water-repellent regions 3 of the ejection orifice face) 4. Accordingly, an ink is difficult to stay on the outer surfaces 40*a* of the protrusions 5, and thus an ink is prevented from adhering onto the protrusions 5.

The water repellency in the present invention means that a water droplet coming into contact with a member does not spread on the member, and the water repellency of a member can be determined by measuring a contact angle (dynamic receding contact angle θr) of a liquid droplet (pure water) on the surface of the member. Specifically described later, the highly water-repellent region in the present invention is, on the outer surface of an ejection orifice, a region having a larger water dynamic receding contact angle than that of a region having a low water repellency. The water dynamic receding contact angle of the highly water-repellent region is preferably larger than that of a region having a low water repellency by 10° or more. The highly water-repellent region preferably has a dynamic receding contact angle of 80° or more. The highly water-repellent region can be formed by the water repellent treatment described later, for example.

(With Regard to Ejection Orifice Shape and Water Repellent Treatment Region)

The shape of the ejection orifice 12 and the water repellent treatment region will next be described.

(Ejection Orifice Shape)

First, the ejection orifice shape applicable to the present embodiment will be described. The ejection orifice 12 has at least one protrusion protruding from the peripheral portion 12*a* of the ejection orifice 12 toward the center of the ejection orifice.

Figure 2:
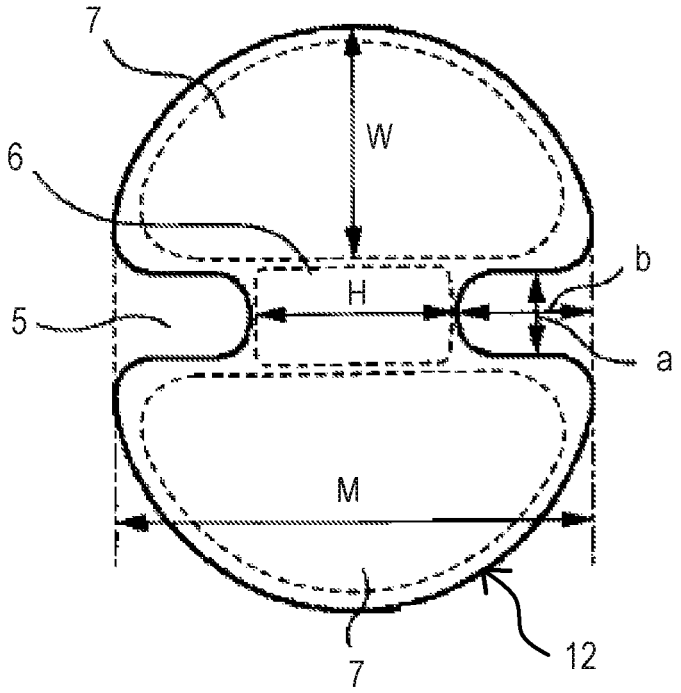
FIG. 2 is a plan view for describing an ejection orifice shape pertaining to an embodiment of the present invention.

Specifically, as shown in FIG. 2, two protrusions 5 each having the width a and the protrude height b are symmetrically provided on an ejection orifice 12, for example. M is the minimum diameter of a virtual outer edge of an ejection orifice without any protrusions (for an ejection orifice having two protrusions, the distance from the base of one protrusion to the base of the opposing protrusion; for an ejection orifice having one protrusion, the distance from the base of the protrusion to the corresponding peripheral edge). The clearance between two protrusions 5 (reduced diameter portion) defines the minimum diameter H of the ejection orifice 12. The reduced diameter portion defined by the width a of the protrusions 5 and the clearance between the protrusions 5 is a high fluid resistance region 6 as a first region having a markedly high fluid resistance as compared with other portions in the ejection orifice 12. Both sides of the high fluid resistance region 6 as a boundary (in FIG. 2, upper and lower sites of the protrusion 5), low fluid resistance regions 7 are formed as second regions. The difference in fluid resistance between the high fluid resistance region 6 and the low fluid resistance regions 7 is preferably sufficiently large. Hence, the protrusions 5 are preferably provided locally. The fluid resistance in the low fluid resistance regions 7 is preferably not so high as compared with an ejection orifice having no protrusion 5. With such a structure, the outer edge shape of the ejection orifice 12 can be any of a circle, ellipse, quadrangular, star, and other shapes. As described above, the protrusion may have any shape capable of forming the high fluid resistance region 6 and the low fluid resistance region 7. Specifically, in FIG. 2, the width W of the low fluid resistance region 7 is preferably larger than the width H of the reduced diameter portion.

(With Regard to Water Repellent Treatment Region)

The water repellent treatment region will next be described. As described in FIG. 1 and FIG. 8, a highly water-repellent region 3 having a high water repellency is formed in a region including the protrusion edge 1 on the outer surface 40*a* of the protrusion 5. The outer surface of the ejection orifice except the highly water-repellent region 3 is a region having a comparatively low water repellency 4. In order to stably form an ink meniscus on the ejection orifice at the time of ink ejection, the inner wall 12*b* of the ejection orifice 12 is preferably subjected to no water repellent treatment.

Figure 3:
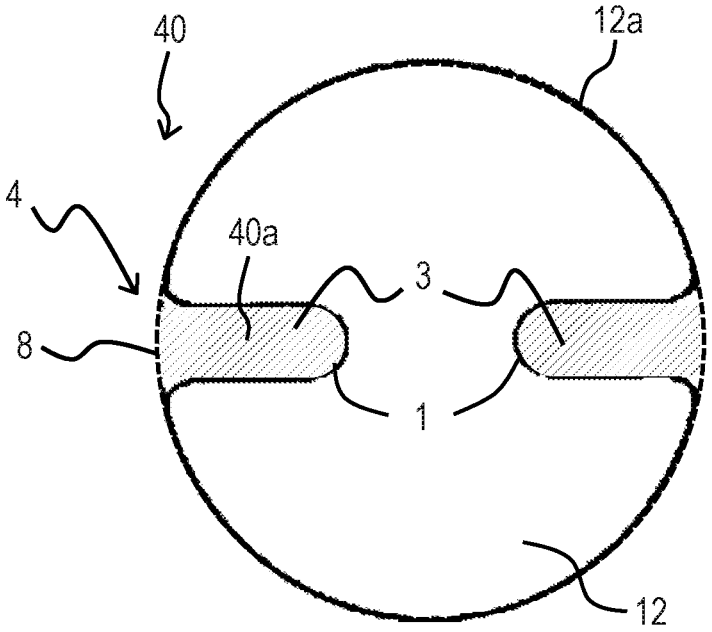
FIG. 3 is a plan view for describing an ejection orifice shape pertaining to an embodiment of the present invention.

An ink pool moves to the region having a low water repellency 4 side only after the ink pool reaches the boundary 3*a* between the highly water-repellent region 3 and the region having a low water repellency 4. Hence, a highly water-repellent region 3 excessively extending in the outward direction is unfavorable because a larger amount of an ink conversely stays on the outer surface 40*a* of the protrusion 5. Specifically, as shown in FIG. 3, a highly water-repellent region 3 is provided more closely to the center (inside) of the ejection orifice 12 than the virtual outer edge 8 of an ejection orifice 12 without any protrusions. In this case, the ejection orifice peripheral face 40 is the region having a low water repellency 4.

Figure 4:
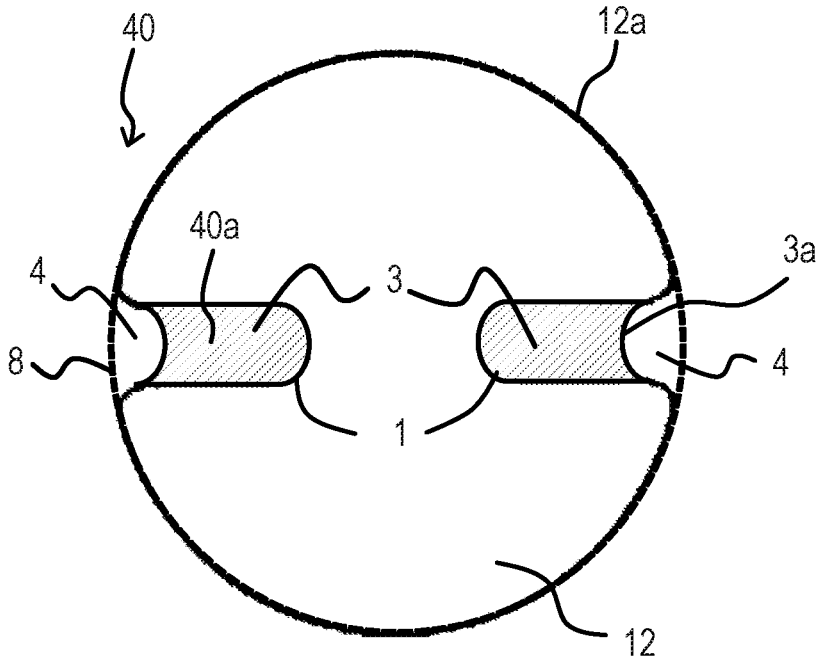
FIG. 4 is a plan view for describing an ejection orifice shape pertaining to an embodiment of the present invention.

As shown in FIG. 4, the boundary 3*a* is preferably provided in a region more closely to the center of the ejection orifice 12 than the virtual outer edge 8. In other words, narrower, highly water-repellent regions 3 are preferably formed. In this case, the region having a low water repellency 4 extends to the outer surface 40*a* of each protrusion 5 from the virtual outer edge 8 of the ejection orifice 12. Also in this case, the highly water-repellent region 3 is so formed as to include the protrusion edge 1.

Figure 5:
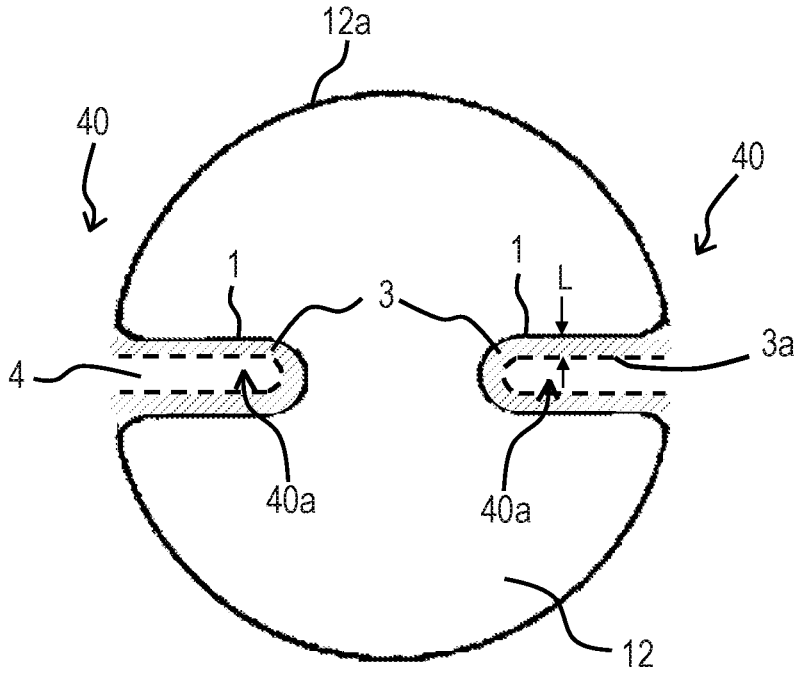
FIG. 5 is a plan view for describing an ejection orifice shape pertaining to an embodiment of the present invention.

The position of the boundary 3*a* of two regions can be adjusted to correspond to the amount of an ink pool that causes an ink mist, an ink overflow, or the like to affect printing. As an example, as shown in FIG. 5, the boundary 3*a* is particularly preferably provided on the outer surface 40*a* of each protrusion 5 at such a position that the width L from the protrusion edge 1 as the outer periphery of the protrusion 5 toward the inside is 50% or less of the width a of the protrusion 5. For example, for a protrusion 5 having a width a of 3.0 μm, the width L can be 0.5 μm or less. In other words, the highly water-repellent region 3 is formed along the protrusion edge 1 to include the protrusion edge 1 of the protrusion 5. The region having a low water repellency 4 is formed in the central part of the outer surface 40*a* of each protrusion 5. With such a structure, an ink adhering to the outer surface 40*a* of the protrusion 5 moves along the region having a low water repellency 4 from the outer surface 40*a* of the protrusion 5 toward the ejection orifice peripheral face 40. Accordingly, an ink does not stay on the outer surfaces 40*a* of the protrusions 5.

(With Regard to Method for Producing Ink Jet Head)

A method for producing an ink jet head pertaining to the present embodiment will next be described with reference to drawings. In the present embodiment, a highly water-repellent region and a region having a low water repellency are required to be formed with precise location accuracy. Hence, in the present embodiment, an ink jet head is produced by photolithography capable of forming a pattern with high precision.

Figure 6:
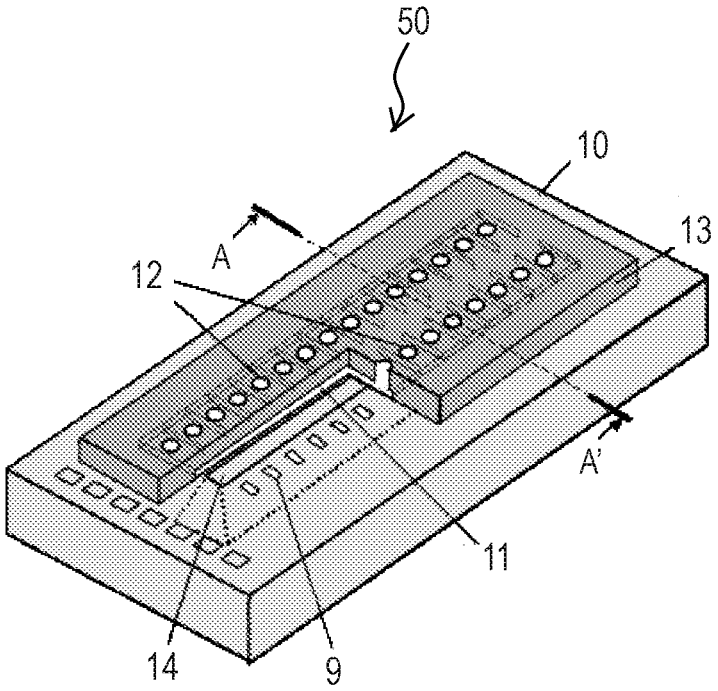
FIG. 6 is a perspective view of an ink jet head formed by a method pertaining to an embodiment of the present invention.

FIG. 6 is a schematic perspective view showing an ink jet head 50 in the present embodiment. The ink jet head 50 shown in FIG. 6 includes a substrate 10 having a plurality of energy generating elements (resistive heating elements or piezoelectric elements, for example) 9 configured to generate energy used for ejecting an ink. The substrate 10 includes flow channels 11 for holding an ink and an ejection orifice forming member 13 defining ejection orifices 12 that communicate with the flow channels 11 and are for ejecting an ink. The substrate 10 also includes a supply port 14 penetrating the substrate 10 and for supplying an ink to the flow channels 11. Hereinafter, steps in an embodiment of a method for producing the ink jet head 50 in the present embodiment will be described with reference to FIGS. 7A to 7H showing A-A' cross sections in FIG. 6.

(Method for Producing Ink Jet Head)

On a substrate 10 with energy generating elements 9, a positive photosensitive resin-containing positive photosensitive resin layer (not shown) to be a mold for flow channels 11 is formed. The positive photosensitive resin is not limited to particular resins. In order to prevent patterning properties from degrading due to sensitization at the time of exposure of the photocationic polymerizable resin layer 16 described later, a material having a low absorbance to the light used for exposure of the photocationic polymerizable resin layer 16 is preferred. For example, when the light is ultraviolet light such as i-rays (365 nm), polymethyl isopropenyl ketone or the like that is photosensitive to deep UV light can be used as the positive photosensitive resin. To form the positive photosensitive resin layer, for example, a positive photosensitive resin is appropriately dissolved in a solvent, then the solution is applied by spin coating, and the coating is prebaked, thereby enabling the formation of a positive photosensitive resin layer. The thickness of the positive photosensitive resin layer corresponds to the height of low channels, thus is appropriately designed in accordance with the ejection design of an ink jet head, and is preferably 5 to 22 μm, for example.

Figure 7A:
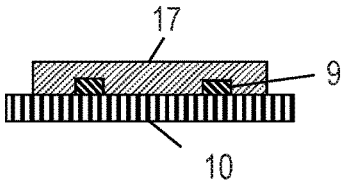
FIGS. 7A, 7B, 7C, 7D, 7E, 7F, 7G and 7H are cross-sectional views for describing a method for producing an ink jet head pertaining to an embodiment of the present invention.

Next, the positive photosensitive resin layer is subjected to patterning to form a mold 17 (FIG. 7A). To pattern the positive photosensitive resin layer, for example, active energy rays to which the positive photosensitive resin is sensitive are applied to the positive photosensitive resin layer through a mask, thereby performing pattern exposure. The positive photosensitive resin layer is then developed with a solvent or the like that can dissolve the exposed portion, and is rinsed, thereby enabling the formation of a mold 17.

Figure 7B:
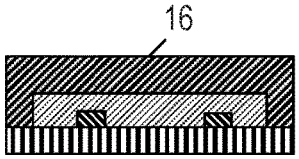

Next, on the mold 17 and the substrate 10, a photocationic polymerizable resin layer 16 containing a photocationic polymerizable resin material and a photocationic polymerization initiator is formed (FIG. 7B). Examples of the photocationic polymerizable resin material include epoxy compounds, vinyl ether compounds, and oxetane compounds. Of them, the photocationic polymerizable resin material is preferably an epoxy compound from the viewpoint of high mechanical strength and strong adhesion to a ground material. Examples of the epoxy compound include bisphenol-A epoxy resins and novolac epoxy resins. Examples of the commercial product thereof include "EHPE-3150" (trade name, manufactured by Daicel), "Celloxide (registered trademark) 2021" (trade name, manufactured by Daicel), "GT-300 series" (trade name, manufactured by Daicel), "GT-400 series" (trade name, manufactured by Daicel), "157S70" (trade name, manufactured by Japan Epoxy Resin Co., Ltd), "EPICLON (registered trademark) N-865" (trade name, manufactured by Dainippon Ink and Chemicals, Inc.), and "SU8" (trade name, manufactured by Nippon Kayaku Co., Ltd.). The epoxy compound preferably has an epoxy equivalent of 2,000 or less and more preferably 1,000 or less. When the epoxy equivalent is 2,000 or less, the cross-linking density is not reduced at the time of curing reaction, and the reduction in glass transition temperature and adhesion of a cured product can be suppressed. The epoxy equivalent is determined in accordance with JIS K-7236.

As the photocationic polymerization initiator, onium salts such as ionic sulfonium salts and iodonium salts can be used, for example. From the viewpoint of cationic polymerization activity, an onium salt having a phosphoric anion, $PF_6$, or an antimony anion, $SbF_6$, is preferred. Examples of the commercial product thereof include "SP-170" (trade name, manufactured by ADEKA) and "SP-172" (trade name, manufactured by ADEKA). The photocationic polymerizable resin layer can be formed by, for example, applying a solution of a photocationic polymerizable resin material and a photocationic polymerization initiator dissolved in an appropriate solvent onto the mold 17 and the substrate 10 by spin coating and then prebaking the coating. When a solvent is used, a solvent not dissolving the mold 17 is selected and used. The photocationic polymerizable resin layer 16 may have any thickness, and the thickness on the mold 17 can be 15 to 75 μm, for example.

Figure 7C:
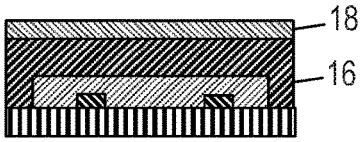

Next, on the uncured photocationic polymerizable resin layer 16, a water-repellent layer 18 containing a fluorine compound (water-repellent material) having a fluorine-containing group is formed (FIG. 7C). The fluorine compound in the present embodiment has such characteristics that the fluorine-containing group is eliminated by photoirradiation.

In the present embodiment, the fluorine-containing group is not eliminated in the first exposure step for forming an ejection orifice pattern, and thus the water repellency is not reduced as described later. In the second exposure step, the fluorine compound absorbs irradiation energy to eliminate the fluorine-containing group. Hence, the water repellency is reduced, and a highly water-repellent region and a region having a low water repellency are formed on the same face of the water-repellent layer 18. Such a fluorine compound preferably contains a carbonyl group that is bonded to the fluorine-containing group. Typically, a carbonyl group absorbs a light having a wavelength of 300 nm or less. Hence, for example, the first exposure step is performed with i-rays having a wavelength of 365 nm, and in the second exposure step, a light having a wavelength of 300 nm or less is applied. Consequently, a region having a higher water repellency and a region having a lower water repellency can be formed. In the present embodiment, examples of the carbonyl group bonded to a fluorine-containing group include groups represented by Formula (1).

$$F—Rf\text{-}A\text{-}C(=O)\text{-}A\text{-} \qquad \text{Formula (1)}$$

(In the formula, Rf is a perfluoroalkyl group or a perfluoropolyether group; and A is a direct bond, an aliphatic group having 1 to 12 carbon atoms and optionally having an oxygen atom or a nitrogen atom, an aromatic group having 6 to 10 carbon atoms and optionally having an oxygen atom, an alicyclic group, urethane, or a $—CH_2CH(OT)CH_2—$ group, where T is a hydrogen atom or an acetyl group, $CH_3CO—$.)

The fluorine-containing group is preferably a perfluoroalkyl group or a perfluoropolyether group from the viewpoint of water repellency.

Specific examples include fluorine compounds containing, as the perfluoroalkyl group, a group represented by Formula (2):

$$—(CF_2)_k— \qquad \text{Formula (2)}$$

(in the formula, k is an integer of 3 or more).

Examples also include fluorine compounds containing, as the perfluoropolyether group, a group represented by Formula (3):

Formula (3)

$$—(CF_2CF_2CF_2O)_p—(CF_2CF_2O)_q—\left(\underset{\displaystyle CF_3}{\underset{|}{CF}}—CF_2—O\right)_r—(CF_2O)_s—$$

(in the formula, p, q, r, and s are 0 or an integer of 1 or more, and at least one of them is an integer of 1 or more).

When the numbers of repeating units of these water repellent groups (k, p, q, r, s) are compared, p, q, r, and s are typically larger than k in many commercially available water-repellent materials. Hence, a water-repellent material having a perfluoropolyether group contains more fluorine atoms per molecule than a water-repellent material having a perfluoroalkyl group, thus exhibits high water repellency, and is preferably used. The perfluoropolyether group moiety preferably has an average molecular weight of 500 or more in order to help the water-repellent material to exhibit water repellency. In order to achieve the solubility in a solvent, the average molecular weight is preferably 20,000 or less. More preferably, the perfluoropolyether group moiety has an average molecular weight of 1,000 to 10,000. The average molecular weight of a perfluoropolyether group moiety can be determined by F-NMR.

The fluorine compound is required to have high mechanical strength or low solubility in solvents such as an ink and thus also preferably has an inorganic reactive group. From the viewpoint of versatility, a compound having a hydrolyzable silane group at a terminal is also preferably used.

Specific examples of the compound containing a hydrolyzable silane group include compounds represented by Formula (4).

$$F—Rf—D—[Q—SiR_aY_{3-a}]_n \qquad \text{Formula (4)}$$

(In the formula, Rf is a perfluoroalkyl group or a perfluoropolyether group; R is a hydrolyzable substituent; Y is a nonhydrolyzable substituent; D is an aliphatic group having 1 to 12 carbon atoms and having an oxygen atom including a carbonyl group and a nitrogen atom; Q is an organic group having 1 to 12 carbon atoms; n is an integer of 1 or more; and a is an integer from 1 to 3.)

Examples of the hydrolyzable substituent include halogen atoms, alkoxy groups, an amino group, and a hydrogen atom. Of them, highly versatile alkoxy groups such as a methoxy group and an ethoxy group are preferred. Examples of the nonhydrolyzable group include alkyl groups such as a methyl group and an ethyl group.

Specific examples of the hydrolyzable silane compound having a perfluoropolyether group include compounds represented by Formula (5).

Formula (5)

$$F—\underset{\displaystyle CF_3}{\underset{|}{(CFCF_2O)_t}}—\underset{\displaystyle CF_3}{\underset{|}{CF}}—\overset{\displaystyle O}{\overset{\|}{C}}—\underset{\displaystyle CH_2CH_2CH_2—Si(OCH_3)_3}{\underset{|}{N}}—CH_2CH_2CH_2—Si(OCH_3)_3$$

(In the formula, t is an integer from 3 to 60.)

The fluorine compound containing a hydrolyzable silane group can be selected from the viewpoint of the reactivity with a photocationic polymerizable resin layer as the ejection orifice forming member, mechanical strength, and ink resistance. Specifically, a condensate containing a hydrolyzable silane compound having a perfluoroalkyl group or a perfluoropolyether group and a hydrolyzable silane compound having a cationic polymerizable group is also preferably used. When the hydrolyzable silane compound having a cationic polymerizable group is contained, mechanical strength and ink resistance are improved. This is because a cationic polymerizable group is reacted between a fluorine compound and a photocationic polymerizable resin layer as the ejection orifice forming member in the presence of a cationic polymerization initiator to form an ether bond.

A condensate containing an alkyl-substituted hydrolyzable silane compound in addition to the hydrolyzable silane compound can also be preferably used, for example. When containing an alkyl-substituted hydrolyzable silane compound, the condensate obtains a higher degree of freedom. Hence, the hydrolyzable silane compound having a perfluoroalkyl group or a perfluoropolyether group is more likely to be oriented toward the air interface side. When an alkyl group or the like is contained, the cleavage of a siloxane bond is suppressed, and the water repellency and the ink resistance are improved.

The fluorine compound in the present embodiment is also preferably used as a polymer prepared by polymerization of a unit formed from a monomer represented by Formula (6) in order to improve the coating properties.

Formula (6)

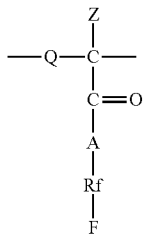

(In the formula, Rf is a perfluoroalkyl group or a perfluoropolyether group; A is a direct bond, an aliphatic group having 1 to 12 carbon atoms and optionally having an oxygen atom or a nitrogen atom, an aromatic group having 6 to 10 carbon atoms and optionally having an oxygen atom, an alicyclic group, urethane, or a —$CH_2CH(OT)CH_2$— group, where T is a hydrogen atom or an acetyl group, $CH_3CO$—; Q is an organic group having 1 to 12 carbon atoms; and Z is a hydrogen atom or a methyl group.)

When used, a fluorine compound represented by Formula (6) is also preferably used as a copolymer with a polymer prepared by polymerization of units formed from such monomers as represented by Formula (7) and Formula (8), for the above reason of improving the coating properties.

Formula (7)

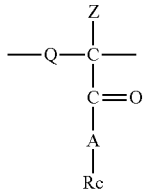

(In the formula, Rc is a cationic polymerizable group; A is a direct bond, an aliphatic group having 1 to 12 carbon atoms and optionally having an oxygen atom or a nitrogen atom, an aromatic group having 6 to 10 carbon atoms and optionally having an oxygen atom, an alicyclic group, urethane, or a —$CH_2CH(OT)CH_2$— group, where T is a hydrogen atom or an acetyl group, $CH_3CO$—; Q is an organic group having 1 to 12 carbon atoms; and Z is a hydrogen atom or a methyl group.)

Formula (8)

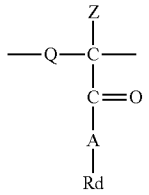

(In the formula, Rd is an alkyl group, an aryl group, or a reactive silane group; A is a direct bond, an aliphatic group having 1 to 12 carbon atoms and optionally having an oxygen atom or a nitrogen atom, an aromatic group having 6 to 10 carbon atoms and optionally having an oxygen atom, an alicyclic group, urethane, or a —$CH_2CH(OT)CH_2$— group, where T is a hydrogen atom or an acetyl group, $CH_3CO$—; Q is an organic group having 1 to 12 carbon atoms; and Z is a hydrogen atom or a methyl group.)

The water-repellent layer 18 can be formed by, for example, spin coating, slit coating, roll coating, dip coating, vacuum depositing, or a similar method of a solution of a fluorine compound dissolved in an appropriate solvent. The thickness of the water-repellent layer 18 is preferably 50 to 10,000 nm and more preferably 80 to 5,000 nm in order to achieve sufficient water repellency and durability. When the film thickness is 50 nm or more, uniform water repellency and sufficient durability are achieved. When the film thickness is 10,000 nm or less, the degradation of patterning characteristics including the pattern deformation and the resolution reduction can be suppressed.

With reference to FIGS. 7A to 7H again, a first exposure step is performed (FIG. 7D). In the first exposure step, a first exposure light 20 is applied from above the water-repellent layer 18 through a first mask 19 to a curing region of the photocationic polymerizable resin layer 16 and the water-repellent layer 18. The first mask 19 has such a pattern that a part of the water-repellent layer 18 (a part to be an ejection orifice) is the unexposed portion. As the first exposure light 20, a light having a wavelength capable of generating acid from a photocationic polymerization initiator can be applied, and i-rays can be used, for example. In the region exposed to the first exposure light (i-rays) 20, the acid generated from the photocationic polymerization initiator present in the photocationic polymerizable resin layer 16 diffuses into the water-repellent layer 18. As a result, when the water-repellent layer 18 has a cationic polymerizable group, the cationic polymerizable group is reacted to form an ether bond in the photocationic polymerizable resin layer 16 and the water-repellent layer 18, improving the mechanical strength and the ink resistance. When the water-repellent layer 18 contains a hydrolyzable silane compound, hydrolysis with water in air proceeds in the water-repellent layer 18 to form a silanol group. In addition, the generated acid accelerates the dehydration condensation reaction to form a siloxane bond, improving the mechanical strength. The silanol group is further reacted with the cationic polymerizable group or a hydroxy group in a photocationic polymerizable resin layer, improving the mechanical strength and the ink resistance. Through these actions, in the region exposed to the first exposure light 20, the photocationic polymerizable resin layer 16 and the water-repellent layer 18 can be integrally cured to ensure the adhesion. The unexposed portions 42 are portions where ejection orifices 12 are to be formed.

Figure 7D:
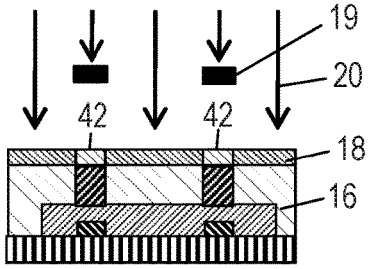
Figure 7E:
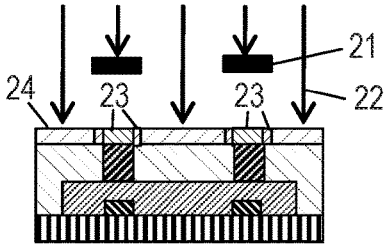

Next, a second exposure step is performed (FIG. 7E). In the second exposure step, a second exposure light 22 is applied through a second mask 21 so as to expose the region to have a low water repellency. The second mask 21 has such a pattern that the unexposed regions 42 in the first exposure step and at least a part of the protrusion region to maintain water repellency (for example, the whole protrusion or the highly water-repellent region 3 in FIG. 5) are the unexposed portion. In the second exposure step, unlike the first exposure step, a light having a wavelength capable of degrading a fluorine compound, for example, a wavelength of 300 nm or less, is applied to degrade the fluorine compound (to eliminate a fluorine-containing group). In the exposed region 24 in the second exposure step, a fluorine-containing group is eliminated, and thus the water repellency is reduced. The unexposed regions 23 in the second exposure step are regions 23 maintaining the water repellency. In the unexposed regions 23 in the second exposure step, the unexposed regions 42 in the first exposure step are removed in the development step described later to give ejection orifices 12. The development step can be performed before the second exposure step to form ejection orifices 12, and then the second exposure step can be performed to form regions having a lower water repellency.

An ink staying on a protrusion is about several picoliters of liquid micro-droplet and thus easily moves on an ejection orifice face. Hence, even when the difference in water repellency between a highly water-repellent region and a region having a low water repellency is small, the effect of the invention is exerted. Specifically, the difference in water repellency between a highly water-repellent region and a region having a low water repellency is preferably 10° or more in terms of dynamic receding contact angle. Hence, the exposure amount in the second exposure step is preferably 1/10 or more the exposure amount in the first exposure step.

Figure 7F:
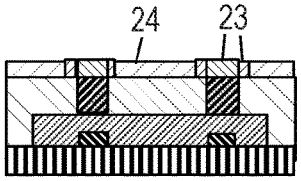

Next, a heat treatment is performed to accelerate the integral curing of the photocationic polymerizable resin layer 16 and the water-repellent layer 18 (FIG. 7F). By the heat treatment, the reaction in the exposed region 24 in the first exposure step is accelerated to impart resistance against the following development step. The heat treatment can be performed with a hot plate, for example. The temperature of the heat treatment is not limited to particular values and can be 70 to 100° C., for example. The time of the heat treatment is not limited to particular values and can be 3 to 5 minutes, for example.

Figure 7G:
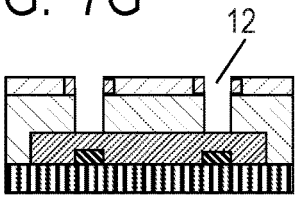

Next, the unexposed regions 42 of the photocationic polymerizable resin layer 16 and the water-repellent layer 18 in the first exposure step are removed by development, thereby forming ejection orifices 12 (FIG. 7G). By the development, the degradation product in the second exposure step is also removed. The developer used in the development may be any solution that can develop the photocationic polymerizable resin layer 16 and the water-repellent layer 18 in the unexposed regions 42. As the developer, for example, a mixed solvent of MIBK (methyl isobutyl ketone) and xylene can be used.

Figure 7H:
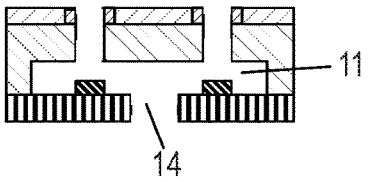

Next, a supply port 14 is formed in the substrate 10. The mold 17 is then removed to form flow channels 11 (FIG. 7H). The supply port 14 can be formed by, for example, anisotropic etching with an alkaline solution when the substrate 10 is a silicon substrate. The flow channels 11 can be formed by, for example, immersing the substrate 10 in a solvent capable of dissolving the mold 17 to remove the mold 17. As needed, the mold 17 can be exposed to active energy rays to which the mold is photosensitive, thereby improving the solubility of the mold 17. Next, electrical connection for driving the energy generating elements 9 is performed. Ink supplying members for supplying an ink or the like are further connected, thereby completing an ink jet head.

A printing apparatus pertaining to an embodiment includes the above liquid ejection head. A printing method pertaining to an embodiment uses the above printing apparatus to eject an ink from the printing apparatus, thereby applying the ink to a printing object.

EXAMPLES

Hereinafter, Examples and Comparative Examples are described, but the present invention is not limited thereto. Preparations and evaluations of various test samples were performed by the following procedures.

(Print Evaluation Method)

(Evaluation of Number of Satellites)

A thermal ink jet head was prepared, and the state of an ejecting liquid was observed by stroboscopic photography to determine the time for separating the ejecting liquid and the liquid droplet length from the top to the end of a liquid droplet immediately after the separation of the ejecting liquid. The separation time of an ejecting liquid is the time from the application of voltage to a heater to the separation of a liquid column from a liquid film. The electric power applying time to a heater was controlled so as to give an ejection speed of 13 m/s. The ink used was PGI-2300BK. The number of satellites was the average number of satellites where the satellite observation was repeated ten times.

(Evaluation of Print Deflection)

A print test was performed with a printer, MB5330 (trade name), manufactured by Canon in an environment at 30° C. and 80% RH, and the probability of print deflection of dots was visually compared. As the print test, a continuous print test without blade wiping and a print test after blade wiping were performed. In the continuous print test, solid color printing was continuously performed without blade wiping on five A4-size papers. In the print test after blade wiping, blade wiping was continuously performed 15,000 times or 30,000 times, and then the character "H" in the alphabet was continuously printed on 100 A4-size papers. In each test, when deflection was observed at at least one position in an A4-size paper, such a sample was determined to have print deflection, and the probability was calculated.

(Water Repellency Evaluation)

To evaluate the water repellency of an ejection face, dynamic receding contact angles θr were measured with a micro contact angle meter (product name: DropMeasure, manufactured by Microjet), and the difference between a highly water-repellent region and a region having a low water repellency was calculated. The region subjected to the water repellent treatment had an extremely small area and was failed to be subjected to the measurement. Hence, a larger area was separately subjected to the water repellent treatment to prepare a sample, and the difference in water repellency between the highly water-repellent region and the region having a low water repellency was evaluated.

Example 1

Through the steps shown in FIGS. 7A to 7H, an ink jet head was prepared. Onto a substrate 10 with energy generating elements 9, polymethyl isopropenyl ketone (trade name, "ODUR-1010" (trade name), manufactured by Tokyo Ohka Kogyo Co., Ltd.) as the positive photosensitive resin to be a mold for ink flow channels was applied by spin coating. The coated substrate was heated at 120° C. for 6 minutes to give a positive photosensitive resin layer having a thickness of 14 μm. Next, an exposure apparatus UX3000 (trade name, manufactured by USHIO Inc.) was used to perform pattern exposure for the ink flow channels, and the exposed portion of the positive photosensitive resin layer was developed with MIBK (methyl isobutyl ketone). The developed substrate was then rinsed with IPA (isopropyl alcohol), giving a mold 17 (FIG. 7A).

Next, as an ejection orifice forming member of a photocationic polymerization resin layer for forming ejection orifices, a photocationic polymerizable resin solution having the formulation shown in Table 1 was applied by spin coating. The coated substrate was then heated at 60° C. for 9 minutes to give, on the mold 17 and the substrate 10, a photocationic polymerizable resin layer 16 having a thickness of 25 μm on the mold (FIG. 7B).

TABLE 1

| Formulation of photocationic polymerizable resin solution | | |
|---|---|---|
| Epoxy resin | EHPE-3150, Daicel Chemical | 100 parts by mass |
| Additive | 1, 4-HFAB, Central Glass | 20 parts by mass |
| Photocationic polymerization initiator | SP-172, ADEKA | 6 parts by mass |
| Silane coupling agent | A-187, GE Toshiba Silicone | 5 parts by mass |
| Solvent | Xylene, Kishida Chemical | 70 parts by mass |

Next, as a fluorine-containing compound for forming a water-repellent layer 18, a condensate derived from the compound represented by Formula (9) below, glycidylpropyltriethoxysilane, and methyltriethoxysilane was diluted with 2-butanol and ethanol. The dilute solution was applied onto the uncured photocationic polymerizable resin layer 16 by slit coating, and the heat treatment at 70° C. for 3 minutes was performed to volatilize the diluting solvent, giving a water-repellent layer 18 having a thickness of 0.5 μm on the photocationic polymerization resin layer 16 (FIG. 7C).

Formula (9)

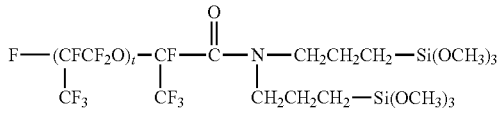

(In the formula, t is 5.)

Next, the first exposure step was performed. An i-ray exposure stepper (manufactured by Canon) was used to perform exposure with a first exposure light 20 at 5,000 J/m$^2$ through such a first mask 19 that the ejection orifice formation regions would be unexposed regions 42 (FIG. 7D). The ejection orifice had a diameter of 7.5 μm, the protrusion had a width of 3.0 μm, and the protrusion tip had a radius (R) of 1.5 μm.

Next, the second exposure step was performed. A second exposure light 22 was used to perform exposure through such a second mask 21 that the highly water-repellent regions 3 shown in FIG. 5 (a range having an inward width of 0.5 μm from each protrusion edge 1) and the unexposed regions in the first exposure step would be unexposed regions 23. As the exposure apparatus, an MA200 compact (trade name, manufactured by SUSS MicroTec) was used to apply a light having a wavelength of 270 nm or less at an exposure amount of 1,000 J/m$^2$ (FIG. 7E).

Next, the exposed substrate was heated on a hot plate at 95° C. for 4 minutes (FIG. 7F). The resulting substrate was developed with a xylene/MIBK (methyl isobutyl ketone) mixed solvent (mass ratio: 6/4) and was rinsed with xylene, and consequently ejection orifices 12 were formed (FIG. 7G).

Next, the substrate 10 was subjected to anisotropic etching with TMAH (tetramethylammonium hydroxide) as an alkaline solution, and a supply port 14 was formed. By immersing the substrate 10 in methyl lactate, the mold 17 was dissolved and removed to form flow channels 11 (FIG. 7H).

Next, electrical connection for driving the energy generating elements was performed. Ink supplying members for supplying an ink or the like were further connected to complete an ink jet head of Example 1, and the ink jet head was evaluated. The evaluation results are shown in Table 2. As shown in the print evaluation, the ink jet head of Example 1 gave a small number of satellites, no print deflection, and high printing qualities.

Examples 2 and 3

The same procedure as in Example 1 was performed except that conditions in Example 1 were changed as shown in Table 2, giving ink jet heads of Examples 2 and 3, and the ink jet heads were evaluated. The evaluation results are shown in Table 2.

Example 4

The same procedure as in Example 1 was performed except that the compound represented by Formula (10) below was used as the fluorine-containing compound, giving an ink jet head of Example 4, and the ink jet head was evaluated. The evaluation results are shown in Table 2.

Formula (10)

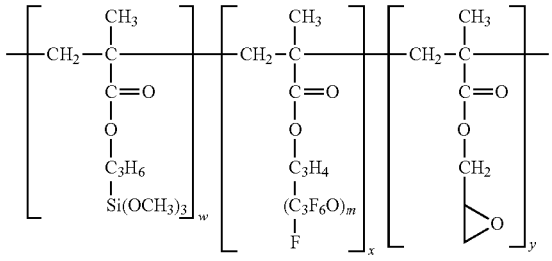

(In the formula, m is 20; w is 25; x is 25; and y is 50.)

Comparative Examples 1 and 2

The same procedure as in Example 1 was performed except that conditions in Example 1 were changed as shown in Table 3, giving ink jet heads of Comparative Examples 1 and 2, and the ink jet heads were evaluated. The evaluation results are shown in Table 3.

In each of Examples 1 to 4, the difference in dynamic receding contact angle θr between the highly water-repellent region and the region having a low water repellency was 10° or more. Each highly water-repellent region had a dynamic receding contact angle θr of 90° or more. The number of satellites in Examples 1 to 4 was 0.5 to 1.3, whereas the number of satellites in Comparative Examples 1 and 2 was as many as 3.2 to 3.3. In the print test result including the continuous print test and the print test after wiping, Examples 1 to 4 show a range of 1 to 2% in many cases, whereas Comparative Examples 1 and 2 show 1 to 5%.

TABLE 2

Test results of ink jet heads in Examples

| | Ejection orifice shape | Ejection orifice diameter (μm) | Protrusion shape: Width (μm) | Protrusion shape: Protrusion tip R (μm) | Highly water-repellent region | Water-repellent layer-forming material Fluorine compound |
|---|---|---|---|---|---|---|
| Example 1 | Shape with protrusion | 7.5 | 3.0 | 1.5 | 0.5 μm width from protrusion edge | Formula (9) |
| Example 2 | Same as Example 1 | Same as Example 1 | Same as Example 1 | Same as Example 1 | Close to center from virtual outer edge | Same as Example 1 |
| Example 3 | Same as Example 1 | Same as Example 1 | Same as Example 1 | Same as Example 1 | Same as Example 1 | Same as Example 1 |
| Example 4 | Same as Example 1 | Same as Example 1 | Same as Example 1 | Same as Example 1 | Same as Example 1 | Formula (10) |

| | Exposure amount in first exposure step | Exposure amount in second exposure step | θr difference (°) | Number of satellites (10-time average) | Continuous print test result | Print test result after blade wiping: 15,000 times | Print test result after blade wiping: 30,000 times |
|---|---|---|---|---|---|---|---|
| Example 1 | 5000 J/m$^2$ | 1000 J/m$^2$ | 20 | 0.5 | 0% | 0% | 1% |
| Example 2 | Same as Example 1 | Same as Example 1 | 20 | 1.1 | 1% | 1% | 2% |
| Example 3 | Same as Example 1 | 500 J/m$^2$ | 10 | 1.3 | 2% | 2% | 3% |
| Example 4 | Same as Example 1 | Same as Example 1 | 15 | 0.6 | 1% | 1% | 2% |

TABLE 3

Test results of ink jet heads in Comparative Examples

| | Ejection orifice shape | Ejection orifice diameter (μm) | Protrusion shape: Width (μm) | Protrusion shape: Protrusion tip R (μm) | Highly water-repellent region | Water-repellent layer-forming material Fluorine compound | θr difference (°) | Number of satellites (10-time average) | Continuous print test result | Print test result after blade wiping: 15,000 times | Print test result after blade wiping: 30,000 times |
|---|---|---|---|---|---|---|---|---|---|---|---|
| Comparative Example 1 | Round shape | Same as Example 1 | None | None | Whole ejection orifice face | Same as Example 1 | 0 | 3.2 | 3% | 0% | 1% |
| Comparative Example 2 | Same as Example 1 | Same as Example 1 | Same as Example 1 | Same as Example 1 | Same as Comparative Example 1 | Same as Example 1 | 0 | 3.3 | 2% | 3% | 5% |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-113562, filed Jun. 8, 2017, which is hereby incorporated by reference herein in its entirety.

What is claimed is:

1. A liquid ejection head comprising:

an ejection orifice configured to eject a liquid, the ejection orifice having at least one protrusion protruding from a peripheral portion of the ejection orifice toward a center of the ejection orifice, wherein the protrusion includes, on an outer surface including at least a protrusion edge, a highly water-repellent region having a higher water repellency than that of an outer surface of a periphery of the ejection orifice.

2. The liquid ejection head according to claim 1, wherein the highly water-repellent region is formed along the protrusion edge.

3. The liquid ejection head according to claim 2, wherein the highly water-repellent region is a region having an inward width from the protrusion edge, and the inward width is 50% or less of a width of the protrusion.

4. The liquid ejection head according to claim 1, wherein a difference in dynamic receding contact angle between the highly water-repellent region and a region having a lower water repellency than that of the highly water-repellent region is 10° or more.

5. The liquid ejection head according to claim 1, wherein the highly water-repellent region contains a compound having a perfluoropolyether group.

6. The liquid ejection head according to claim 5, wherein the perfluoropolyether group moiety has an average molecular weight of 500 to 20,000.

7. A printing apparatus comprising:

the liquid ejection head according to claim 1.

8. A method for producing a liquid ejection head including an ejection orifice configured to eject a liquid, the ejection orifice having at least one protrusion protruding from a peripheral portion of the ejection orifice toward a center of the ejection orifice, the method comprising:

1) a step of forming a photocationic polymerizable resin layer on a substrate;

2) a step of forming, on the photocationic polymerizable resin layer, a water-repellent layer containing a compound having a fluorine-containing group that is eliminated by photoirradiation;

3) a first exposure step of partly exposing the water-repellent layer and the photocationic polymerizable resin layer to form an ejection orifice pattern;

4) a second exposure step of exposing the water-repellent layer where an outer surface including at least a protrusion edge in a portion to be the protrusion of the ejection orifice is an unexposed portion, thereby eliminating the fluorine-containing group in an exposed portion; and 5) a step of developing the water-repellent layer and the photocationic polymerizable resin layer to form the ejection orifice.

9. The production method according to claim 8, wherein the compound having a fluorine-containing group that is eliminated by photoirradiation is a compound in which the fluorine-containing group is bonded to a carbonyl group.

10. The production method according to claim 8, wherein the fluorine-containing group is a perfluoropolyether group.

11. The production method according to claim 10, wherein the perfluoropolyether group moiety has an average molecular weight of 500 to 20,000.

12. The production method according to claim 8, wherein an exposure light in the first exposure step is an i-ray.

13. The production method according to claim 8, wherein an exposure light in the second exposure step is a light having a wavelength of 300 nm or less.

14. The production method according to claim 8, wherein an exposure amount in the second exposure step is 1/10 or more an exposure amount in the first exposure step.

* * * * *